US011944877B2

(12) United States Patent
Yamamoto et al.

(10) Patent No.: US 11,944,877 B2
(45) Date of Patent: Apr. 2, 2024

(54) RACKET

(71) Applicant: SUMITOMO RUBBER INDUSTRIES, LTD., Hyogo (JP)

(72) Inventors: Yosuke Yamamoto, Hyogo (JP); Naoka Sakamoto, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 620 days.

(21) Appl. No.: 17/159,436

(22) Filed: Jan. 27, 2021

(65) Prior Publication Data

US 2021/0252344 A1 Aug. 19, 2021

(30) Foreign Application Priority Data

Feb. 14, 2020 (JP) ..... 2020-023520

(51) Int. Cl.
*A63B 49/022* (2015.01)
*A63B 102/02* (2015.01)

(52) U.S. Cl.
CPC ..... *A63B 49/022* (2015.10); *A63B 2102/02* (2015.10)

(58) Field of Classification Search
CPC ..... A63B 49/022
See application file for complete search history.

(56) References Cited

U.S. PATENT DOCUMENTS 4,206,917 A * 6/1980 Guillem ..... A63B 60/54 473/534
4,314,699 A * 2/1982 Bayer ..... A63B 49/02 473/544
5,368,297 A * 11/1994 Liu ..... A63B 60/00 473/539
5,435,550 A * 7/1995 You ..... A63B 49/022 473/542
6,050,909 A * 4/2000 Severa ..... A63B 49/028 473/539
6,179,735 B1 * 1/2001 McMahon ..... A63B 49/022 473/534
6,336,877 B1 1/2002 Arroyo et al.
6,764,417 B1 * 7/2004 Filippini ..... A63B 49/022 473/548
9,821,197 B2 * 11/2017 Bothwell ..... A63B 49/022
2019/0184243 A1 6/2019 Yamamoto

FOREIGN PATENT DOCUMENTS

JP 2002-537004 11/2002
JP 2019-107057 7/2019

OTHER PUBLICATIONS

Tennis Warehouse, "Improve your tennis: Tennis String Gauges Explained!", https://www.youtube.com/watch?v=EocxL5XPj0Q, Oct. 18, 2017 (Year: 2017).*

* cited by examiner

*Primary Examiner* — Joshua T Kennedy
(74) *Attorney, Agent, or Firm* — GREENBLUM & BERNSTEIN, P.L.C.

(57) ABSTRACT

A tennis racket includes a frame and a grommet. The frame includes a grommet groove, a small groove, and a hole. The small groove is recessed from the grommet groove. The grommet includes a base and a pipe. In a state where the grommet is attached to the frame, the base is accommodated in the grommet groove, and the pipe extends through the hole. The base is not positioned inside the small groove. Therefore, at the back of a back side surface of the base, there is a space derived from the small groove.

5 Claims, 11 Drawing Sheets

RACKET

CROSS-REFERENCE TO RELATED APPLICATION

This application claims priority to and the benefit of Patent Application No. 2020-023520 filed in JAPAN on Feb. 14, 2020, the entire disclosure of which is incorporated herein by reference.

BACKGROUND OF THE INVENTION

Field of the Invention

The present invention relates to rackets for use in, for example, tennis.

Description of the Related Art

A tennis racket includes a frame and a string. A tennis player hits a ball with the racket. The ball, after being hit, flies toward the opponent's court. A ball that flies at high speed can contribute to the tennis player's win.

Japanese Laid-Open Patent Application Publication No. 2019-107057 discloses a tennis racket having grooves formed in its frame. The racket having the grooves becomes deformed to a great degree upon impact with the ball. Therefore, the racket has excellent rebound performance.

In the old days, the string was directly inserted through holes formed in the frame. On the other hand, in the case of a recent tennis racket, the string is inserted through holes with grommets therebetween.

Japanese National Phase PCT Laid-Open Application Publication No. 2002-537004 discloses a tennis racket including grommets that include shanks. In this racket, space is formed between the frame and the grommets. Therefore, the grommets can deflect toward the frame. The deflection of the grommets contributes to the rebound performance of the racket.

The grooves of the racket disclosed in Japanese Laid-Open Patent Application Publication No. 2019-107057 are exposed on the outer peripheral surface of the head of the racket. Therefore, in the manufacturing of the frame, which includes a grinding process, the grinding causes variation in the depths of the grooves. The variation in the depths of the grooves impairs the rebound performance and the appearance of the racket.

In order to attain sufficient deflection of the grommets disclosed in Japanese National Phase PCT Laid-Open Application Publication No. 2002-537004, the grommets need to have a sufficient thickness. However, when the thickness of the grommets is excessively great, the mass of the racket is great. When the grommets have a great thickness, the grommets protrude from grommet grooves significantly, which causes increase in air resistance during swinging of the racket. The protruding grommets tend to rub against the ground during the swinging. If the grommet grooves are made deep, the protrusion of the grommets from the grooves is reduced. In this case, however, the presence of the deep grommet grooves would impair the strength of the frame. Thus, the improvement of the rebound performance by utilizing the shanks have certain limitations.

An object of the present invention is to provide a racket having excellent rebound performance that is achieved without depending on the specifications of the grommets.

SUMMARY OF THE INVENTION

A racket according to the present invention includes a grommet, a frame, and a string. The grommet includes: a base; and a pipe that rises from the base and through which the string is passed. The frame includes: a grommet groove in which the base is accommodated; and a small groove recessed from the grommet groove.

When a ball or the like is hit with the racket according to the present invention, upon impact with the ball or the like, the base deflects toward the center of the face. The deflection is a minute deformation. After the impact, the deformed base becomes restored. By the deformation and restoration, great kinetic energy is transferred to the ball or the like. The racket has excellent rebound performance.

Preferably, a width of the small groove is greater than or equal to 0.5 mm but less than or equal to 1.5 mm Preferably, a depth of the small groove is greater than or equal to 0.1 mm but less than or equal to 1.0 mm.

Preferably, a ratio of a width of the small groove to a diameter of the string is greater than or equal to 50% but less than or equal to 100%.

A frame for use in a racket according to the present invention is a frame to which a grommet and a string are attachable, the grommet including a base and a pipe that rises from the base. The frame includes: a grommet groove in which the base is accommodated; and a small groove recessed from the grommet groove.

DESCRIPTION OF THE PREFERRED EMBODIMENTS

Hereinafter, the present invention is described in detail based on preferred embodiments with reference to the accompanying drawings.

Figure 1:
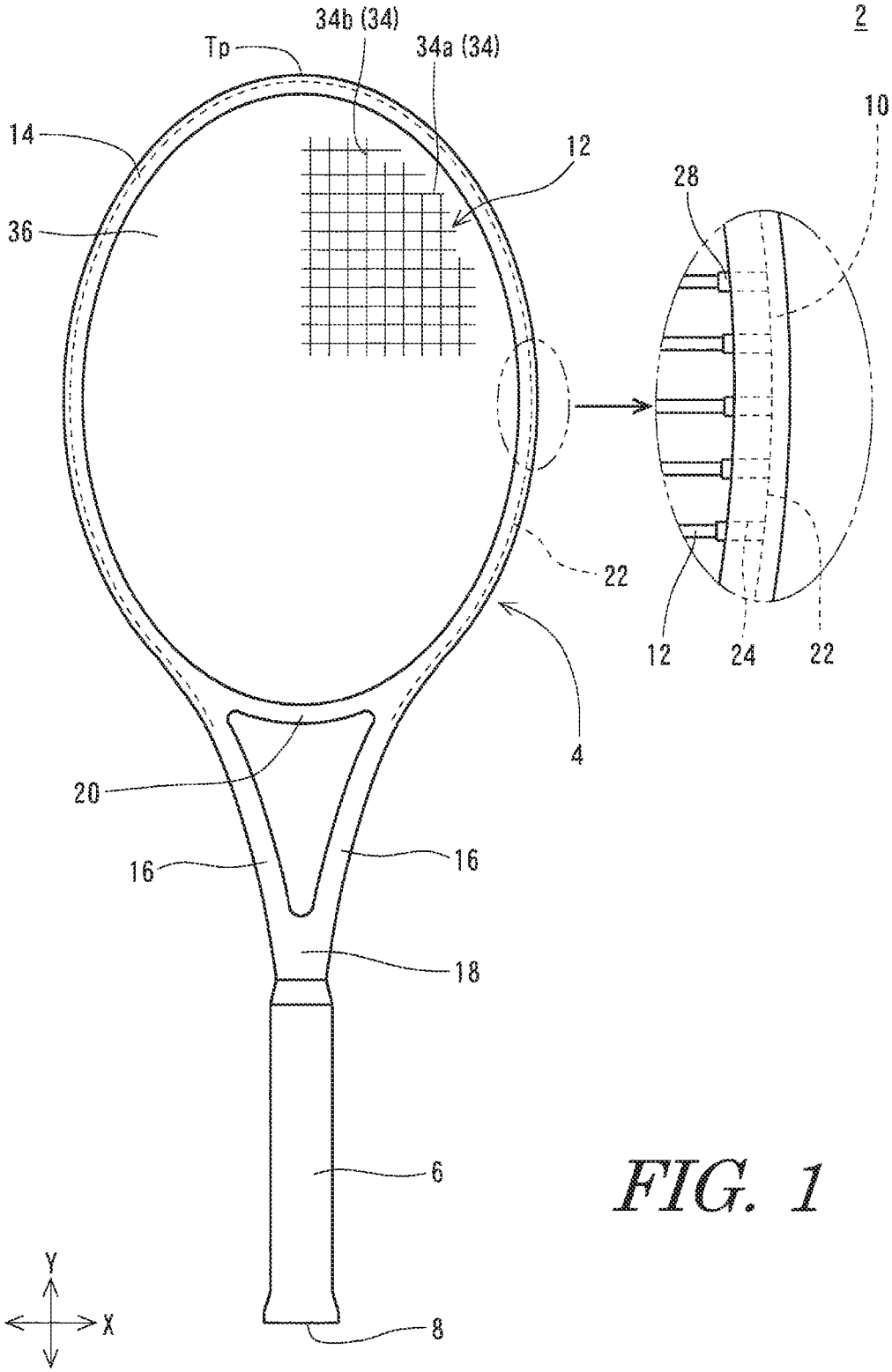
FIG. 1 is a front view of a racket according to one embodiment of the present invention.
Figure 2:
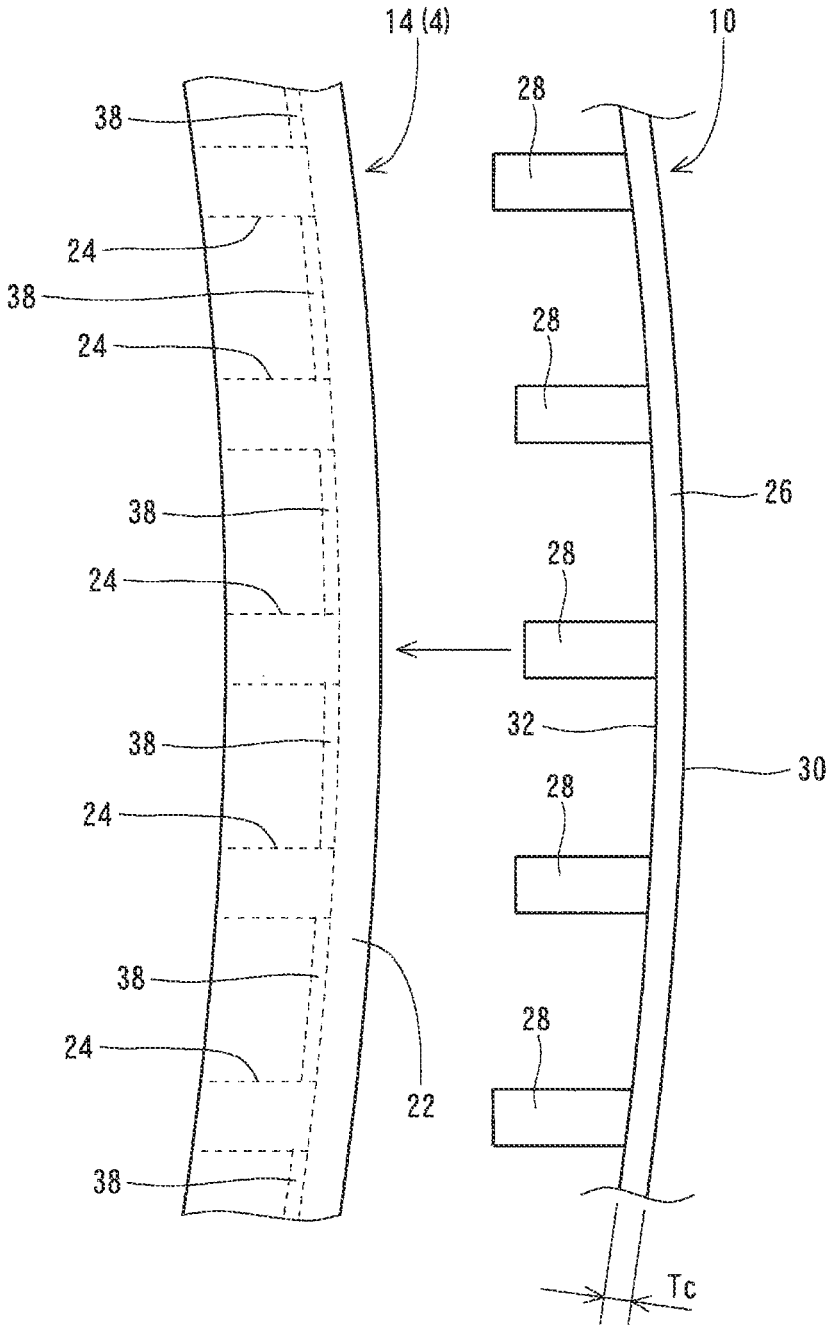
FIG. 2 is an enlarged exploded view of a part of the racket of FIG. 1.

FIGS. 1 and 2 show a tennis racket 2. The tennis racket 2 includes a frame 4, a grip 6, an end cap 8, a grommet 10, and a string 12. The tennis racket 2 can be used in regulation-ball tennis. In FIG. 1, an arrow X represents the width direction of the tennis racket 2, and an arrow Y represents the axial direction of the tennis racket 2.

The frame 4 includes a head 14, two throats 16, and a shaft 18. The head 14 forms the contour of a face (described in detail later). The front shape of the head 14 is substantially an ellipse. The major axis direction of the ellipse coincides with the axial direction Y of the tennis racket 2. The minor axis direction of the ellipse coincides with the width direction X of the tennis racket 2. One end of each throat 16 is continuous with the head 14. At the vicinity of the other end thereof, the throat 16 merges with the other throat 16. The throats 16 extend from the head 14 to the shaft 18. The shaft 18 extends from the location where the two throats 16 merge together. The shaft 18 is formed so as to be continuous with, and integrated with, the throats 16. A portion of the head 14, the portion being positioned between the two throats 16, is a yoke 20. In FIG. 1, the top of the head 14 is denoted by reference sign Tp.

The frame 4 is hollow. The material of the frame 4 is a fiber reinforced resin. In the present embodiment, the matrix resin of the fiber reinforced resin is a thermosetting resin. The thermosetting resin is typically an epoxy resin. The fibers of the fiber reinforced resin are typically carbon fibers. The fibers are filament fibers.

As shown in FIG. 2, the head 14 includes a grommet groove 22. The grommet groove 22 is recessed from the outer peripheral surface of the head 14. As shown in FIG. 1, the grommet groove 22 is formed over substantially the entire periphery of the head 14, except the yoke 20.

The head 14 further includes a plurality of holes 24. Each hole 24 extends through the head 14. The plurality of holes 24 are arranged over substantially the entire periphery of the head 14.

The grip 6 is formed by a tape wound around the shaft 18. The grip 6 suppresses a slip between a hand of a player and the tennis racket 2 when the tennis racket 2 is swung. The end cap 8 is attached to the end of the grip 6.

As shown in FIG. 2, the grommet 10 includes a base 26 and a plurality of pipes 28. The base 26 is belt-shaped. The base 26 includes a front side surface 30 and a back side surface 32. The front side surface 30 has a generally flat shape. The back side surface 32 has a generally flat shape. Each pipe 28 is formed so as to be integrated with the base 26. The pipes 28 rise from the base 26.

In FIG. 2, arrows Tc represent the thickness of the base 26. In light of the strength of the base 26, the thickness Tc is preferably greater than or equal to 0.5 mm, more preferably greater than or equal to 0.7 mm, and particularly preferably greater than or equal to 0.8 mm. In respect of weight reduction, the thickness Tc is preferably less than or equal to 1.5 mm, more preferably less than or equal to 1.3 mm, and particularly preferably less than or equal to 1.2 mm.

The material of the grommet 10 is typically a synthetic resin that is softer than the frame 4. The racket 2 may include a plurality of grommets 10. Each grommet 10 may be spaced apart from its adjacent grommet(s) 10. The number of pipes 28 of each grommet 10 may be one.

The grommet 10 is attached to the head 14. In a state where the grommet 10 is attached to the head 14, the base 26 is accommodated in the grommet groove 22. The base 26 may partly protrude from the grommet groove 22. Further, in the state where the grommet 10 is attached to the head 14, the pipes 28 extend through the respective holes 24.

As shown in FIG. 1, the string 12 is stretched on the head 14. The string 12 is stretched along the width direction X and the axial direction Y. The string 12 forms a large number of threads 34. Of the string 12, portions extending along the width direction X are referred to as transverse threads 34*a*. Of the string 12, portions extending along the axial direction Y are referred to as longitudinal threads 34*b*. A face 36 is formed by a plurality of transverse threads 34*a* and a plurality of longitudinal threads 34*b*. The face 36 generally extends along an X-Y plane. The face 36 may be formed by two or more strings 12.

Figure 3:
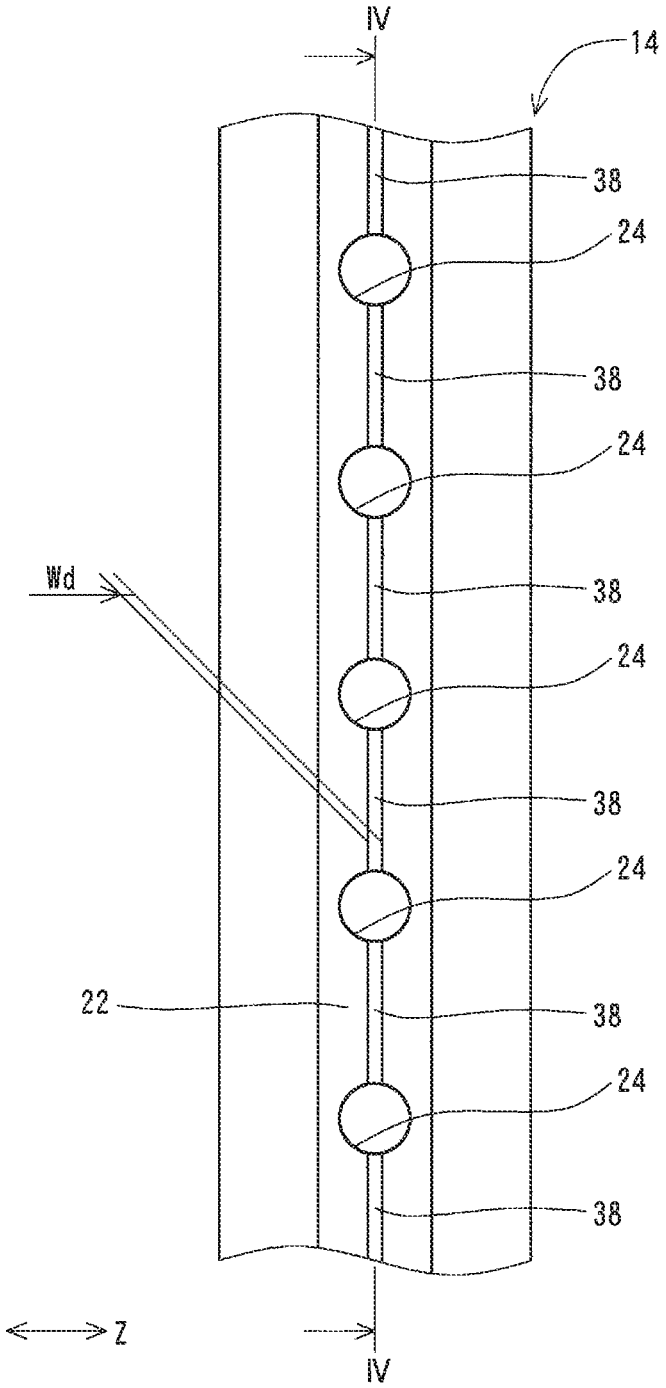
FIG. 3 is an enlarged right side view of a part of the head of the racket of FIG. 1.
Figure 4:
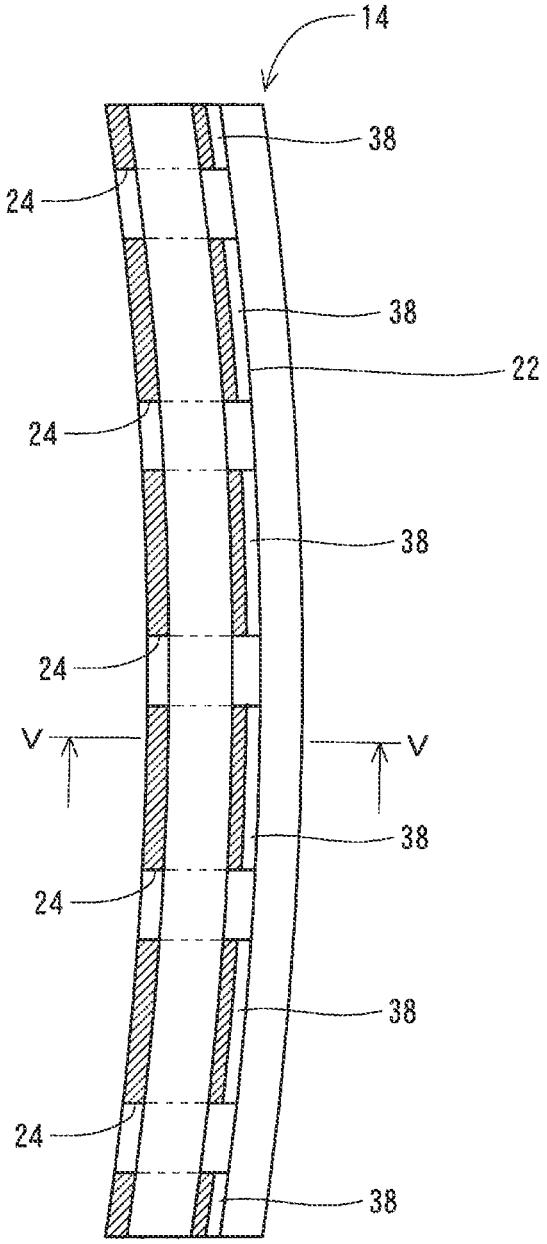
FIG. 4 is a sectional view taken along line IV-IV in FIG. 3.
Figure 5:
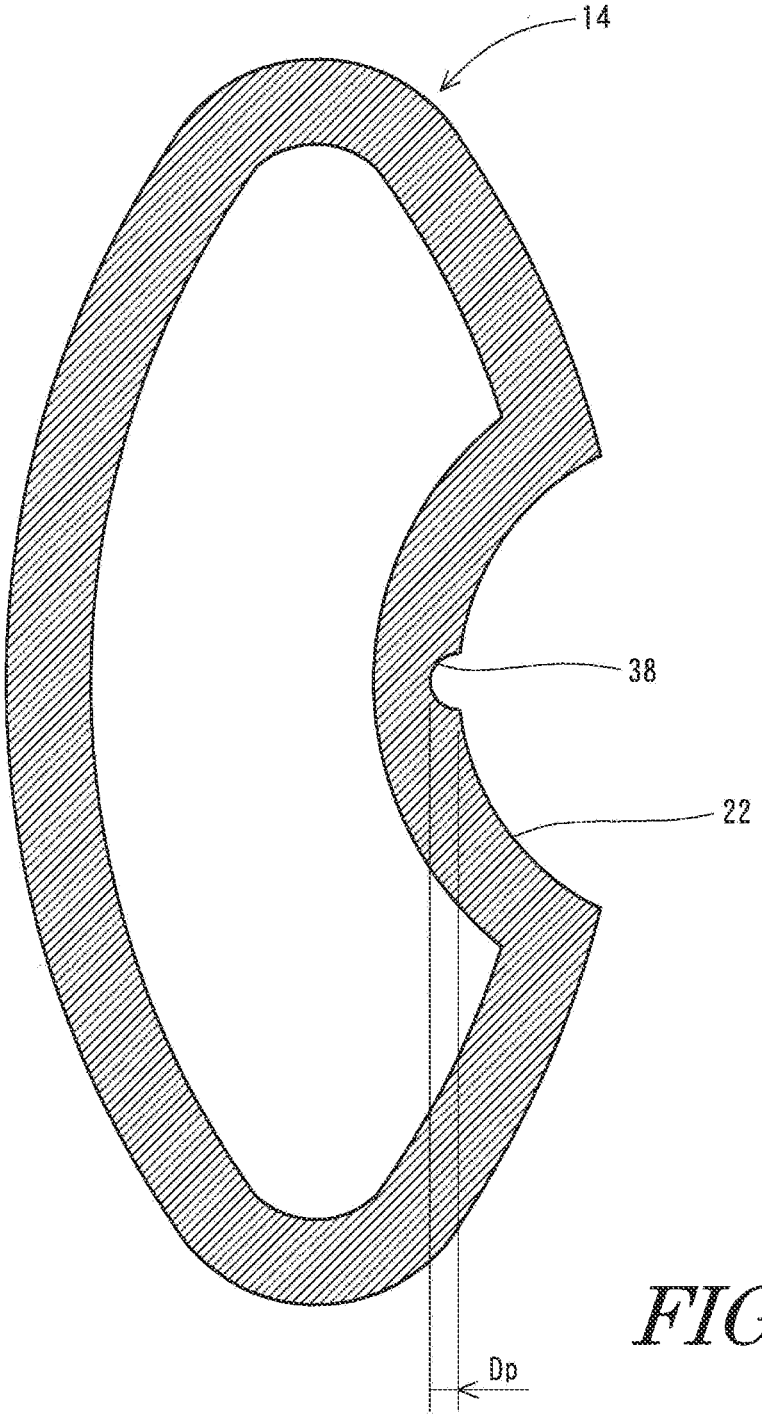
FIG. 5 is an enlarged sectional view taken along line V-V in FIG. 4.

FIG. 3 is an enlarged right side view of a part of the head 14 of FIG. 1. FIG. 4 is a sectional view taken along line IV-IV in FIG. 3. FIG. 5 is an enlarged sectional view taken along line V-V in FIG. 4. The grommet 10 and the string 12 are not shown in FIGS. 3 to 5. In FIG. 3, an arrow Z represents the thickness direction.

As shown in FIGS. 3 to 5, the frame 4 includes plurality of small grooves 38. As shown in FIGS. 4 and 5, each small groove 38 is recessed from the grommet groove 22. As shown in FIGS. 3 and 4, each small groove 38 is sandwiched between two holes 24. The small groove 38 extends from one hole 24 to the other hole 24, which is adjacent to the one hole 24. The small grooves 38 are formed over substantially the entire head 14, except the yoke 20. As shown in FIG. 5, in the present embodiment, each small groove 38 has a generally semicircular cross-sectional shape. Alternatively, each small groove 38 may have a different cross-sectional shape.

Figure 6:
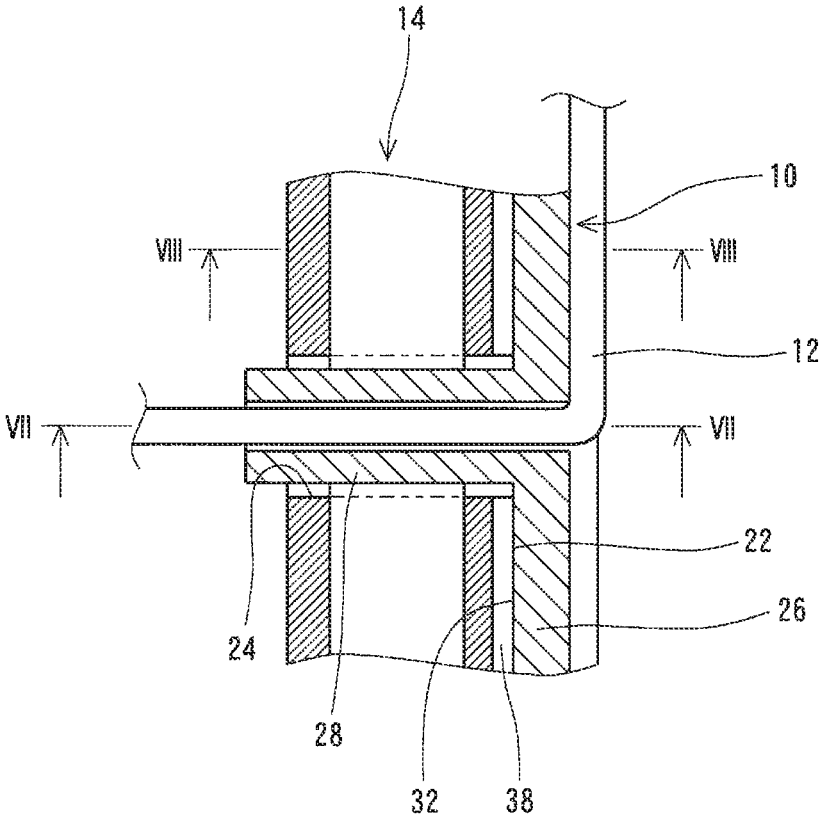
FIG. 6 is an enlarged view in which a part of the head of FIG. 4 is shown together with a grommet and a string.
Figure 7:
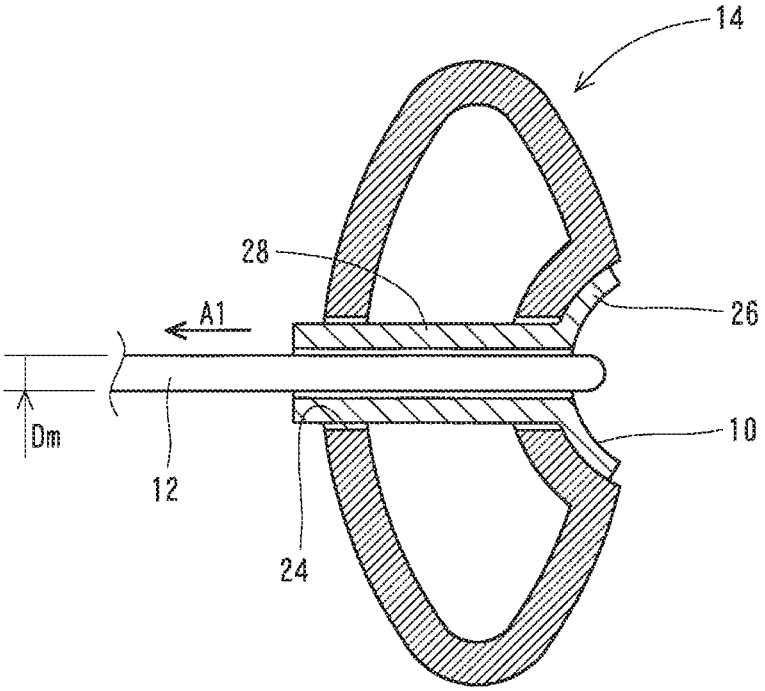
FIG. 7 is a sectional view taken along line VII-VII in FIG. 6.
Figure 8:
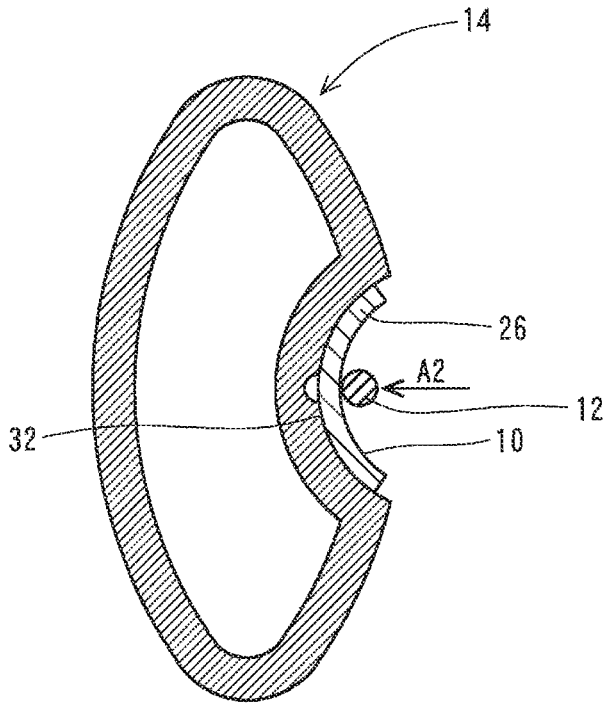
FIG. 8 is a sectional view taken along line VIII-VIII in FIG. 6.

FIG. 6 is an enlarged view in which a part of the head 14 of FIG. 4 is shown together with the grommet 10 and the string 12. FIG. 7 is a sectional view taken along line VII-VII in FIG. 6. FIG. 8 is a sectional view taken along line VIII-VIII in FIG. 6.

In FIGS. 6 to 8, the grommet 10 is attached to the head 14. The base 26 is accommodated in the grommet groove 22. The back side surface 32 of the base 26 is in contact with the bottom surface of the grommet groove 22. Each pipe 28 extends through the corresponding hole 24. The axial direction of the pipe 28 roughly coincides with the axial direction of the hole 24.

In FIGS. 6 to 8, the string 12 is stretched on the head 14. As shown in FIG. 6, a part of the string 12 is in contact with the base 26. The string 12 is bent at the vicinity of the boundary between the base 26 and the pipe 28. A part of the string 12 extends through the pipe 28.

It is clear from FIGS. 6 and 8 that substantially the entire base 26 is not positioned inside the small groove 38. The base 26 is spaced apart from the bottom of the small groove 38. Therefore, at the back of the back side surface 32 of the base 26, there is a space derived from the small groove 38.

When a tennis ball is hit with the tennis racket 2, upon impact with the ball, the face 36 receives an impact shock from the tennis ball. The face 36 becomes deformed due to the impact shock. Specifically, the face 36 deflects in a direction opposite to the swing direction. The deflection causes the string 12 to stretch.

As a result of the stretching of the string 12, tensile force is generated in the string 12 in a direction indicated by an arrow A1 in FIG. 7. Due to the tensile force, a part of the string 12, the part being in contact with the base 26, pushes the base 26 in a direction indicated by an arrow A2 in FIG. 8.

Since the base 26 is thus pushed by the string 12, the base 26 deflects. The direction of the deflection is the direction indicated by the arrow A2 in FIG. 8. As previously mentioned, at the back of the base 26, there is a space derived from the small groove 38. Therefore, the base 26 can deflect without being significantly obstructed by the frame 4. In other words, the base 26 can deflect relatively freely. The amount of deformation of the base 26 at the time is great.

After the impact, the deflected face 36 becomes restored. Also, after the impact, the stretched string 12 becomes restored. Therefore, after the impact, the deflected base 26 becomes restored.

A general tennis racket transfers energy to a tennis ball by the stretching and restoration of the string 12. The tennis racket 2 according to the present invention transfers energy to a tennis ball not only by the stretching and restoration of the string 12, but also by the deflection and restoration of the base 26. When hit with the tennis racket 2, the tennis ball flies at high speed. The tennis racket 2 has excellent rebound performance.

When the tennis ball is hit with the tennis racket 2 at a position away from the center of the face 36, the string 12 does not stretch sufficiently. At the time, however, the deflection of the base 26 compensates for the insufficiency in the stretching of the string 12. Therefore, even when the tennis ball is hit at a position away from the center of the face 36, the tennis ball flies at high speed.

The deflection of the base 26 can also contribute to the absorption of an impact shock. Therefore, even when the tennis ball is hit at a position away from the center of the face 36, the tennis racket 2 allows the player to have excellent hitting feeling.

The small grooves 38 of the tennis racket 2 are covered by the base 26. Therefore, the small grooves 38 do not impair the appearance of the tennis racket 2. In addition, since portions in the vicinity of the small grooves 38 do not directly collide with the ground, the tennis racket 2 is not easily damaged.

The base 26 of the tennis racket 2 need not be thick. Therefore, the tennis racket 2 can be made lightweight. In the tennis racket 2, the amount of protrusion of the base 26 from the grommet groove 22 is small. Therefore, air resistance during swinging of the tennis racket 2 is small. The grommet 10 of the tennis racket 2 is suppressed from rubbing against the ground. The tennis racket 2 may include, together with the small grooves 38, the grommets disclosed in Japanese National Phase PCT Laid-Open Application Publication No. 2002-537004, i.e., the grommets including the shanks.

In FIG. 3, an arrow Wd represents the width of the small groove 38. The width Wd is measured along the thickness direction. The width Wd is preferably greater than or equal to 0.5 mm but less than or equal to 1.5 mm. If the tennis racket 2 has the width Wd of greater than or equal to 0.5 mm, the base 26 deflects sufficiently. In light of this, the width Wd is more preferably greater than or equal to 0.7 mm, and particularly preferably greater than or equal to 0.8 mm. If the tennis racket 2 has the width Wd of less than or equal to 1.5 mm, it reduces hindrance to escaping of a part of the base 26, the part having entered the small groove 38, from the small groove 38. In light of this, the width Wd is more preferably less than or equal to 1.3 mm, and particularly preferably less than or equal to 1.2 mm.

In FIG. 7, an arrow Dm represents the diameter of the string 12. The ratio of the width Wd of the small groove 38 to the diameter Dm of the string 12 is preferably greater than or equal to 50% but less than or equal to 100%. If the tennis racket 2 has the ratio Wd/Dm of greater than or equal to 50%, the base 26 deflects sufficiently. In light of this, the ratio Wd/Dm is more preferably greater than or equal to 60%, and particularly preferably greater than or equal to 65%. If the tennis racket 2 has the ratio Wd/Dm of less than or equal to 100%, it reduces hindrance to escaping of a part of the base 26, the part having entered the small groove 38, from the small groove 38. In light of this, the ratio Wd/Dm is more preferably less than or equal to 90%, and particularly preferably less than or equal to 85%. If the string 12 has a non-circular cross-sectional shape, the diameter of a circle circumscribing this shape is the diameter Dm.

In FIG. 5, an arrow Dp represents the depth of the small groove 38. The depth Dp is preferably greater than or equal to 0.1 mm but less than or equal to 1.0 mm. If the tennis racket 2 has the depth Dp of greater than or equal to 0.1 mm, the base 26 deflects sufficiently. In light of this, the depth Dp is more preferably greater than or equal to 0.2 mm, and particularly preferably greater than or equal to 0.3 mm. The tennis racket 2 having the depth Dp of less than or equal to 1.0 mm has excellent strength. In light of this, the depth Dp is more preferably less than or equal to 0.8 mm, and particularly preferably less than or equal to 0.7 mm.

In the present embodiment, as mentioned above, the plurality of small grooves 38 are formed over substantially the entire head 14. Alternatively, the small grooves 38 may be formed only over part of the head 14. In the present embodiment, the transverse threads 34*a* are shorter than the longitudinal threads 34*b*. Therefore, the amount of stretch of the transverse threads 34*a* tends to be less than the amount of stretch of the longitudinal threads 34*b*. In the head 14, each small groove 38 is formed in a zone that is positioned between two transverse threads 34*a*, and thereby the small grooves 38 compensate for the insufficiency in the amount of stretch of the transverse threads 34*a*.

Hereinafter, one example of a method of manufacturing the tennis racket 2 according to the present invention is described. In this manufacturing method, a mandrel, a tube, and a plurality of prepregs are prepared. Each prepreg is made from a plurality of reinforced fibers arranged in parallel and a matrix resin. In this manufacturing method, first, the mandrel is inserted into the tube. The prepregs are sequentially wound around the tube. As a result of being wound around the tube, the prepregs have a cylindrical shape.

After the mandrel is removed from the tube, the tube and the prepregs are set in a mold. The mold has small ridges (lines of projections) on its cavity surface. In the mold, gas is injected into the tube, thereby inflating the tube. The prepregs are pressed against the cavity surface of the mold by the inflation. The prepregs are heated to cure the matrix resin. A molded article is obtained by the curing. The molded article has a reverse shape of that of the cavity surface. The molded article has the small grooves 38. The small grooves 38 have a reverse shape of that of the ridges.

The holes 24 are drilled in the molded article. The molded article is further subjected to treatments such as surface polishing and painting, and thereby the frame 4 is obtained. Components such as the grip 6 and the grommet 10 are attached to the frame 4. Further, the string 12 is stretched on the frame 4, and thus the manufacturing of the tennis racket 2 is completed.

Figure 9:
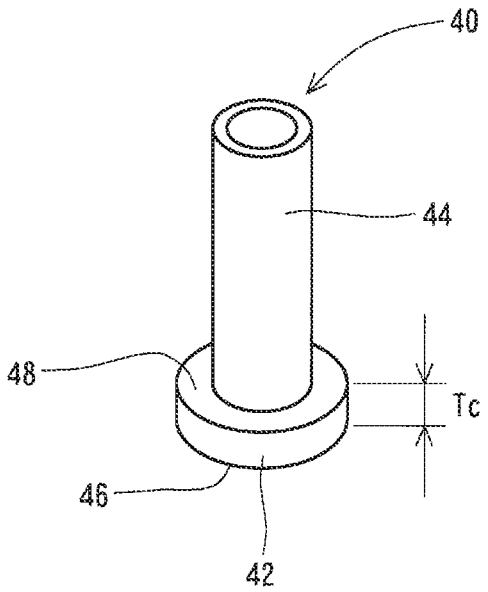
FIG. 9 is a perspective view of a grommet of a racket according to another embodiment of the present invention.

FIG. 9 is a perspective view of a grommet 40 of a racket according to another embodiment of the present invention. Although not illustrated, similar to the racket 2 shown in FIGS. 1 to 8, the frame of the racket according to this other embodiment also includes the grommet groove and the small grooves.

The grommet 40 includes a base 42 and a pipe 44. The base 42 is disc-shaped. The base 42 includes a front side surface 46 and a back side surface 48. The front side surface 46 has a generally flat shape. The back side surface 48 has a generally flat shape. The pipe 44 is formed so as to be integrated with the base 42. The pipe 44 rises from the base 42.

In FIG. 9, arrows Tc represent the thickness of the base 42. The thickness Tc shown in FIG. 9 is equal to the thickness Tc shown in FIG. 2.

As mentioned above, the frame of the racket includes the grommet groove. In a state where the grommet 40 is attached to the frame, the back side surface 48 is in contact with the bottom of the grommet groove.

As mentioned above, the frame of the racket includes the small grooves. Therefore, in this racket, there is a space at the back of the back side surface 48. The base 42 of the racket can easily become deformed due to stretching of the string. The racket transfers energy to a ball (or a shuttle) not only by the stretching and restoration of the string, but also by the deflection and restoration of the base 42. When hit with the racket, the ball or the like flies at high speed. The racket has excellent rebound performance.

EXAMPLES

Experiment 1

Example 1

The prepreg matrix resin was cured in the mold having the ridges, and thereby a frame was produced. By using the frame, the tennis racket shown in FIGS. 1 to 8 was obtained. The racket includes a large number of small grooves. The width Wd of each small groove is 1.0 mm. The depth Dp of each small groove is 0.5 mm.

Comparative Example 1

A tennis racket of Comparative Example 1 was obtained in the same manner as Example 1, except that a mold used in Comparative Example 1 was different from the mold used in Example 1. The mold used in Comparative Example 1 does not have the ridges. Therefore, the tennis racket of Comparative Example 1 does not include the small grooves.

Rebound Coefficient

A tennis ball was flown at a speed of 30 m/s, and brought into collision with the face of each tennis racket. After the collision, the tennis ball rebounded. The speed of the tennis ball immediately before the collision, and the speed of the tennis ball immediately after the collision, were measured, and a rebound coefficient was calculated based thereon. The rebound coefficient was thus measured at five measurement points shown in Table 1 below. In Table 1, x is a distance in the X direction from an origin, and y is a distance in the Y direction from the origin. The origin is the center of the face.

TABLE 1

Measurement points of the rebound coefficient.

| | | |
|---|---|---|
| First measurement point | x = −6 cm | y = 0 cm |
| Second measurement point | x = −3 cm | y = 0 cm |
| Third measurement point | x = 0 cm | y = 0 cm |
| Fourth measurement point | x = 3 cm | y = 0 cm |
| Fifth measurement point | x = 6 cm | y = 0 cm |

Figure 10:
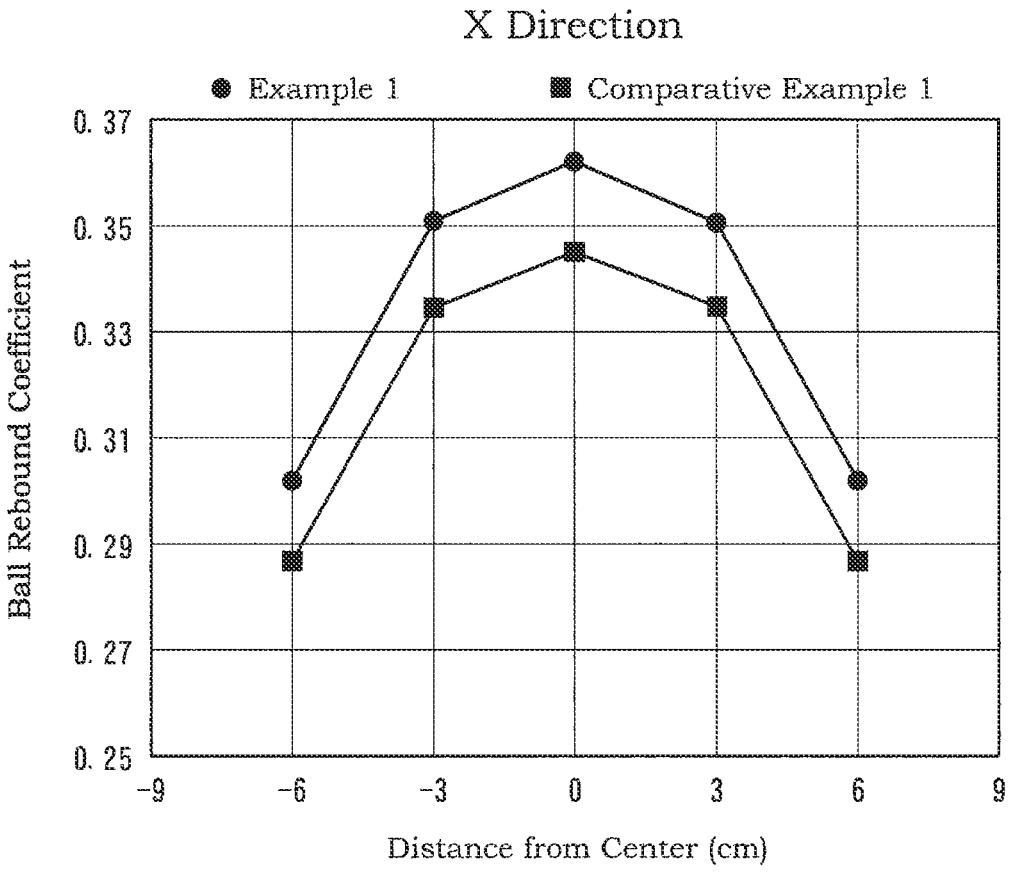
FIG. 10 illustrates a graph showing evaluation results of a racket according to Example 1 of the present invention together with evaluation results of a racket of Comparative Example 1.

FIG. 10 illustrates a graph showing the measurement results. In FIG. 10, the horizontal axis indicates the distance from the center to each measurement point, and the vertical axis indicates the rebound coefficient. It is clear from FIG. 10 that the tennis racket of Example 1 has excellent rebound performance over its entirety in the width direction.

Experiment 2

For each of the tennis rackets of Example 1 and Comparative Example 1 used in Experiment 1, the rebound coefficient was measured at eight measurement points shown in Table 2 below. In Table 2, x is a distance in the X direction from an origin, and y is a distance in the Y direction from the origin. The origin is the top of the head.

TABLE 2

Measurement points of the rebound coefficient.

| | | |
|---|---|---|
| First measurement point | x = 0 cm | y = 9 cm |
| Second measurement point | x = 0 cm | y = 12 cm |
| Third measurement point | x = 0 cm | y = 15 cm |
| Fourth measurement point | x = 0 cm | y = 18 cm |
| Fifth measurement point | x = 0 cm | y = 21 cm |
| Sixth measurement point | x = 0 cm | y = 24 cm |
| Seventh measurement point | x = 0 cm | y = 27 cm |
| Eighth measurement point | x = 0 cm | y = 30 cm |

Figure 11:
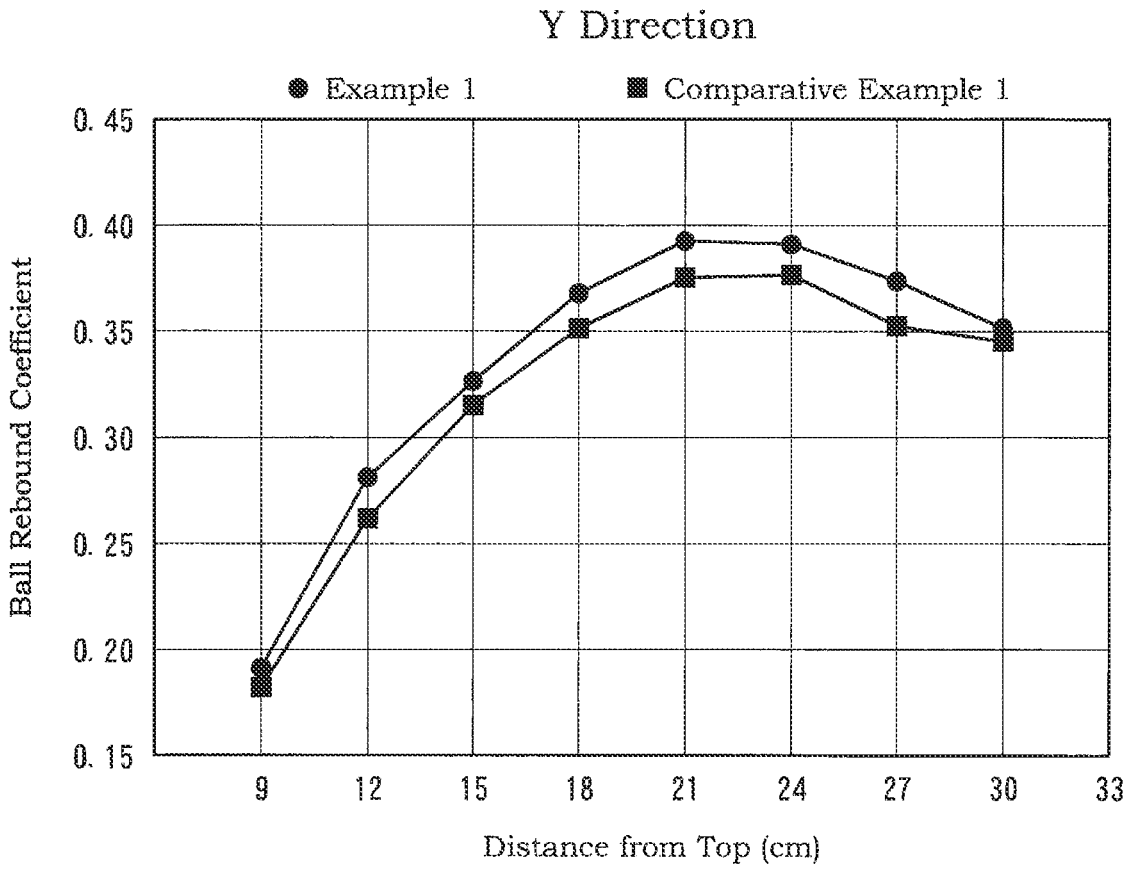
FIG. 11 illustrates a graph showing evaluation results of the racket according to Example 1 of the present invention together with evaluation results of the racket of Comparative Example 1.

FIG. 11 illustrates a graph showing the measurement results. In FIG. 11, the horizontal axis indicates the distance from the top to each measurement point, and the vertical axis indicates the rebound coefficient. It is clear from FIG. 11 that the tennis racket of Example 1 has excellent rebound performance over its entirety in the axial direction.

Experiment 3

Examples 2 to 4

Tennis rackets of Examples 2 to 4 were obtained in the same manner as Example 1, except that different molds were used in Examples 1 to 4, respectively. The groove sizes of these tennis rackets are shown in Table 3 below.

Rebound Coefficient

The rebound coefficient at the center of the face of each tennis racket was measured by using the same method as that of Experiment 1. The measurements results are shown in Table 3 below.

TABLE 3

Measurement results of the rebound coefficient.

| | Wd | Dp | Rebound Coefficient |
|---|---|---|---|
| Example 2 | 0.5 mm | 0.5 mm | 0.355 |
| Example 1 | 1.0 mm | 0.5 mm | 0.361 |
| Example 3 | 1.5 mm | 0.5 mm | 0.365 |
| Example 4 | 1.0 mm | 0.2 mm | 0.360 |
| Comp. Ex. | 0 mm | 0 mm | 0.346 |

It is clear from Table 3 that the tennis racket of each Example has excellent rebound performance.

CONCLUSION

The results of Experiments 1 to 3 clearly indicate that the present invention is superior.

The racket according to the present invention can be used in various sports, such as soft tennis, squash, and badminton.

The above descriptions are merely illustrative examples, and various modifications can be made without departing from the principles of the present invention.

What is claimed is:

1. A racket comprising a grommet, a frame, and a string, wherein the grommet includes:

a base; and a pipe that rises from the base and through which the string is passed, and the frame includes:

a grommet groove in which the base is accommodated; and a small groove recessed from the grommet groove, wherein the small groove defines an empty space between a bottom surface of the small groove and an opposing surface of the base.

2. The racket according to claim 1, wherein a width of the small groove is greater than or equal to 0.5 mm but less than or equal to 1.5 mm.

3. The racket according to claim 1, wherein a depth of the small groove is greater than or equal to 0.1 mm but less than or equal to 1.0 mm.

4. The racket according to claim 1, wherein a ratio of a width of the small groove to a diameter of the string is greater than or equal to 50% but less than or equal to 100%.

5. A frame for use in a racket, to which a grommet and a string are attachable, the grommet including a base and a pipe that rises from the base, the frame comprising:

a grommet groove in which the base is accommodated; and a small groove recessed from the grommet groove, wherein the small groove defines an empty space between a bottom surface of the small groove and a back side surface of the base in a state that the base is accommodated in the grommet groove.

* * * * *